US007487724B1

(12) United States Patent
Evans et al.

(10) Patent No.: US 7,487,724 B1
(45) Date of Patent: Feb. 10, 2009

(54) LIQUID TRANSFER ARRANGEMENT FOR APPLYING A PRINTING LIQUID TO A PRINTING SURFACE

(76) Inventors: Larry William Evans, P.O. Box 7086, Charlotte, NC (US) 28241; Christopher Harper, 6336 Mock Orange Dr., Charlotte, NC (US) 28277

( * ) Notice: Subject to any disclaimer, the term of this patent is extended or adjusted under 35 U.S.C. 154(b) by 273 days.

(21) Appl. No.: 11/430,756

(22) Filed: May 9, 2006

(51) Int. Cl.
*B41F 31/06* (2006.01)

(52) U.S. Cl. ..... 101/350.1; 101/363; 101/367

(58) Field of Classification Search ..... None
See application file for complete search history.

(56) References Cited

U.S. PATENT DOCUMENTS

| | | | | |
|---|---|---|---|---|
| 3,901,150 | A * | 8/1975 | Kirby, Jr. | 101/363 |
| 4,136,635 | A | 1/1979 | Johansson et al. | 118/50 |
| 4,165,688 | A * | 8/1979 | Leanna et al. | 101/363 |
| 4,384,518 | A | 5/1983 | Albin | 101/40 |
| 4,401,032 | A | 8/1983 | Albin | 101/363 |
| 4,735,144 | A | 4/1988 | Jenkins | 101/464 |
| 4,754,701 | A * | 7/1988 | Batke et al. | 101/207 |
| 4,796,528 | A | 1/1989 | Sarazen | 101/208 |
| 5,012,736 | A * | 5/1991 | Van Kanegan et al. | 101/207 |
| 5,368,893 | A | 11/1994 | Sommer et al. | 427/348 |
| 5,410,961 | A | 5/1995 | DeNicola et al. | 101/363 |
| 5,735,210 | A | 4/1998 | Rogge et al. | 101/366 |
| 6,119,595 | A | 9/2000 | Garris et al. | 101/366 |
| 6,360,660 | B1 | 3/2002 | Allison, Jr. | 101/169 |
| 6,471,773 | B1 | 10/2002 | Atkins | 118/123 |
| 6,539,862 | B2 | 4/2003 | Böck et al. | 101/364 |
| 6,576,059 | B2 | 6/2003 | Burgard | 118/683 |
| 6,581,516 | B1 | 6/2003 | Schönberger | 101/154 |
| 6,796,231 | B2 | 9/2004 | Van Denend et al. | 101/350 |

FOREIGN PATENT DOCUMENTS

| | | | |
|---|---|---|---|
| JP | 03073345 | A | 3/1991 |

* cited by examiner

*Primary Examiner*—Jill E. Culler
(74) *Attorney, Agent, or Firm*—K&L Gates LLP

(57) ABSTRACT

A liquid transfer arrangement for applying a printing liquid to a printing surface, for example, in a printing apparatus comprising a liquid transfer roller, a printing cylinder with a peripheral printing plate in surface contact with the transfer roller, and an impression cylinder in peripheral surface contact with the printing cylinder for conveying a printable substrate therebetween. The liquid transfer arrangement comprises an encasement arcuately surrounding a substantial circumferential portion of the transfer roller surface to define a substantially uniform constricted radial spacing therebetween for containing a limited quantity of the printing liquid to be carried by the transfer roller to the printing cylinder. A device associated with the encasement feeds a printing liquid supply into the radial spacing for take up by the transfer roller surface.

17 Claims, 2 Drawing Sheets

LIQUID TRANSFER ARRANGEMENT FOR APPLYING A PRINTING LIQUID TO A PRINTING SURFACE

BACKGROUND OF THE INVENTION

The present invention relates generally to printing machinery, such as printing presses, which may be used in various applications for applying inks, adhesives, and other liquid coatings to a surface. More particularly, the present invention relates to an improved arrangement for initially delivering and applying the ink, adhesive or other coating liquid to the printing machinery.

In flexographic printing, also known as aniline printing, the printing apparatus fundamentally comprises four basic cylindrical roller components; (a) a printing cylinder, commonly referred to as a plate cylinder, the circumferential peripheral of which carries flexible raised-surface printing plates, (b) an impression cylinder rotatable in peripheral surface contact with the plate cylinder for conveying a printable substrate, such as paper, in the nip region between the printing plates of the plate cylinder and the circumferential surface of the impression cylinder, (c) a cylindrical metering roller, commonly referred to as an anilox roller, having a circumferential periphery wetable with a printing ink or other printing liquid and arranged in peripheral surface contact with the plate cylinder for metered transfer of the printing liquid to the flexible printing places on the plate cylinder, and (d) a delivery device adapted for continually rewetting the peripheral surface of the anilox roller from a supply of the ink or other printing liquid.

One conventional form of known liquid delivery device is a so-called fountain roller device wherein a cylindrical roller rotates with its peripheral surface partially submerged in a reservoir of the printing liquid to maintain the surface constantly wetted with the liquid. Outside of the reservoir, the fountain roller rotates in peripheral contact with the anilox roller to continually transfer the printing liquid over the entire length and circumferential extent of the anilox roller for transfer, in turn, to the printing plates of the plate cylinder and therefrom to the printable substrate traveling over the impression cylinder. As will be appreciated, fountain roller delivery devices of this type apply an excess quantity of the printing liquid to the anilox roller, ordinarily requiring the provision of a wiping device, such as a so-called doctor blade, in contact with the peripheral surface of the anilox roller to remove excess printing liquid in advance of contact with and transfer to the printing plates of the plate cylinder. An alternative liquid delivery arrangement in conventional use replaces the fountain roller device with a dual doctor blade system wherein forwardly and reversely angle doctor blades are disposed in peripheral contact with the rotating anilox roller at circumferential spacings from one another so as to define between the doctor blades a liquid reservoir into which the printing liquid is continually supplied.

While each liquid delivery arrangement serves the intended purpose of insuring that the anilox roller and, in turn, the printing plates of the plate cylinder always remain fully wetted, thereby avoiding defects in the printing of the desired substrate from temporary or periodic starvation of the necessary printing liquid, the disadvantage created is the necessary provision for capturing and either recycling or disposing of the excess printing liquid inherently created. As a attendant result, equipment and operational cost are increased and environmental concerns (also with associated cost) must be addressed.

SUMMARY OF THE INVENTION

It is accordingly an object of the present invention to provide a new and novel arrangement for delivering and applying an ink or other printing liquid to a transfer roller in a printing apparatus which addresses the problems and disadvantages in the prior art. More specifically, it is an object of the present invention to provide a liquid transfer arrangement which will fully, uniformly and consistently wet the transfer surface of a transfer roller with minimal or negligible excess liquid application.

The present invention seeks to address these objects by providing a liquid transfer arrangement basically comprising an encasement which arcuately surrounds a circumferential portion of the transfer surface of the transfer roller so as to define therebetween a substantially uniform constricted radial spacing which is sufficiently narrow for containing only a limited quantity of the printing liquid to be carried by the transfer roller to the printing cylinder, with an associated device arranged to deliver a supply of printing liquid into the radial spacing between the encasement and the transfer roller to be taken up by the circumferential transfer surface of the transfer roller.

Various embodiments of the present invention are possible. In a preferred embodiment the encasement extends axially along substantially the full length of the transfer roller. The encasement may be selectively configured to span differing degrees of arcuate curvature about the circumferential portion of the transfer surface of the transfer roller arcuately surrounded by the encasement. It is presently contemplated that the arcuate span of the encasement should be at least about 30 degrees of the transfer surface, up to substantially the full predominant circumferential extent of the transfer surface other than its nip region which is in contact with the plate cylinder, e.g., up to about 355 degrees of the transfer surface. Most preferably, it is contemplated that the circumferential span of the encasement about the transfer surface should be between about 45 degrees and about 230 degrees of the transfer surface.

The radial spacing between the encasement and the transfer surface of the transfer roller may be also be selectively varied, e.g., in relation to the variable parameters of each particular printing application, such as the printing liquid viscosity and similar variables. Most preferably, it is contemplated that the radial spacing should ordinarily be from about one micron to and including about 6350 microns. In a contemplated embodiment, the radial spacing may be selectively set to approximate a desired coating thickness of the printing liquid on the transfer roller While it is believed to be unnecessary in many application and embodiments of the present invention, a wiping element, such as a doctor blade, may optionally be provided at a terminal end of the encasement (relative to the rotational direction of the transfer roller) for removing any excess printing liquid from the circumferential transfer surface, and an associated device may be provided for collecting any excess printing liquid.

In one contemplated embodiment, the liquid transfer arrangement is embodied in a flexographic printing apparatus wherein the transfer roller is an engraved anilox roller rotatably disposed in peripheral surface contact with a printing cylinder which, in turn, rotates in peripheral surface contact with an impression cylinder for conveying a printable substrate therebetween.

DETAILED DESCRIPTION OF THE PREFERRED EMBODIMENTS

Figure 1:
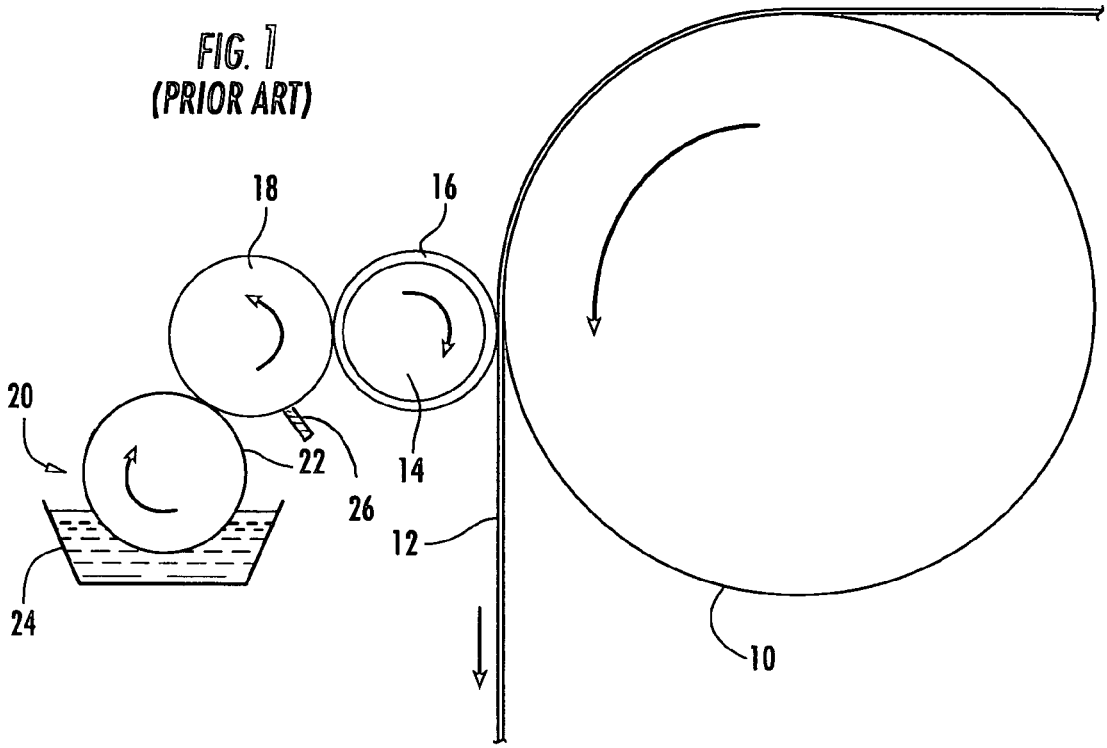
FIG. 1 (PRIOR ART)
FIG. 1 is schematic elevational view of a conventional prior art flexographic printing apparatus utilizing a fountain roller device for delivering and applying a printing liquid to the anilox roller of the apparatus.

Referring now to the accompanying drawings and initially to FIGS. 1 and 2, conventional forms of known flexographic printing apparatus of the type described hereinabove are schematically depicted. Each flexographic printing apparatus basically comprises a rotatably driven impression cylinder 10 adapted to peripherally carry and transport a printable substrate 12, such as paper or a similar web-like material. A so-called plate cylinder 14 is rotatably disposed adjacent the impression cylinder in axially parallel coextensive relation. The circumferential periphery of the plate cylinder 14 carries one or more flexible printing plates 16, typically engraved or otherwise formed with an image surface (not shown), e.g., in a relief image form, for peripherally contacting the circumferential surface of the impression cylinder 10 and the substrate 12 thereon. A cylindrical transfer roller 18 is similarly disposed adjacent the plate cylinder 14 in axially parallel coextensive relation and in peripheral surface contact therewith. The transfer roller 18 is preferably in the form of an anilox roller, with its circumferential surface engraved, e.g., in an intaglio form, with a multitude of recessed cells, which may be of various geometric configurations, adapted collectively to retain a quantity of printing liquid in a continuous film-like form over the circumferential surface of the roller 18 for metered transfer of the liquid to the image surface on the printing plate or plates 16 of the plate cylinder 14.

Figure 2:
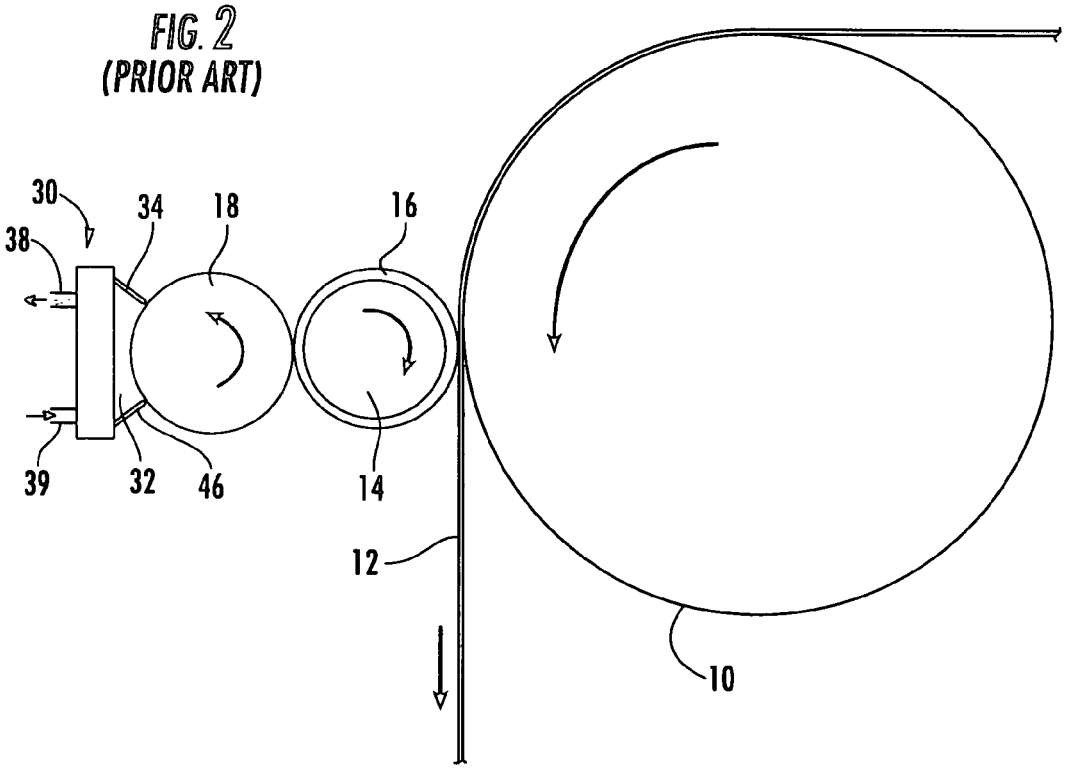
FIG. 2 (PRIOR ART)
FIG. 2 is a schematic elevational view of a conventional prior art flexographic printing apparatus utilizing a dual doctor blade device for delivering and applying a printing liquid to the anilox roller of the apparatus.

The flexographic printing apparatus of FIGS. 1 and 2 differ principally in construction and operation in the form of delivery device provided for applying printing liquid to the transfer roller 18. In prior art apparatus of the type of FIG. 1, the delivery device is in the form of a so-called fountain roller device 20, wherein a cylindrical fountain roller 22 is disposed in axially parallel coextensive relation with the transfer roller 18 for peripheral surface contact therewith, with a downwardly facing lower portion of the fountain roller 22 partially submerged in a reservoir 24 containing a quantity of printing liquid. The fountain roller 22 is continuously driven so as to constantly maintain the entirety of its circumferential periphery fully wetted with the printing liquid and, in turn, via surface contact with the transfer roller 18, to constantly maintain the engraved cell structure of its circumferential surface filled with the printing liquid thereby forming a thin film of the liquid as determined by the size, number, volume and configuration of the cells. Preferably, a doctor blade 26 is positioned in angled surface contact with the transfer roller 18 downstream of the location of its contact with the fountain roller 22, as viewed in the direction of rotation of the transfer roller 18, to progressively wipe excess printing liquid from the surface of the transfer roller 18 to drain back into the reservoir 24.

By contrast, the prior art flexographic printing apparatus of the type of FIG. 2 do not utilize a fountain roller, but instead define a reservoir 32 positioned directly adjacent the transfer roller 18, with forwardly and rearwardly inclined doctor blades 34, 46 disposed in axially extending wiping contact with the surface of the transfer roller 18 at a circumferential spacing from each other. As schematically indicated at 38, 39, printing liquid is continuously delivered into and exhausted from the reservoir 24 so as to maintain a slightly positive fluid pressure within the reservoir. In this manner, the delivery device 30 serves to constantly wet the peripheral surface of the roller 18.

Figure 3:
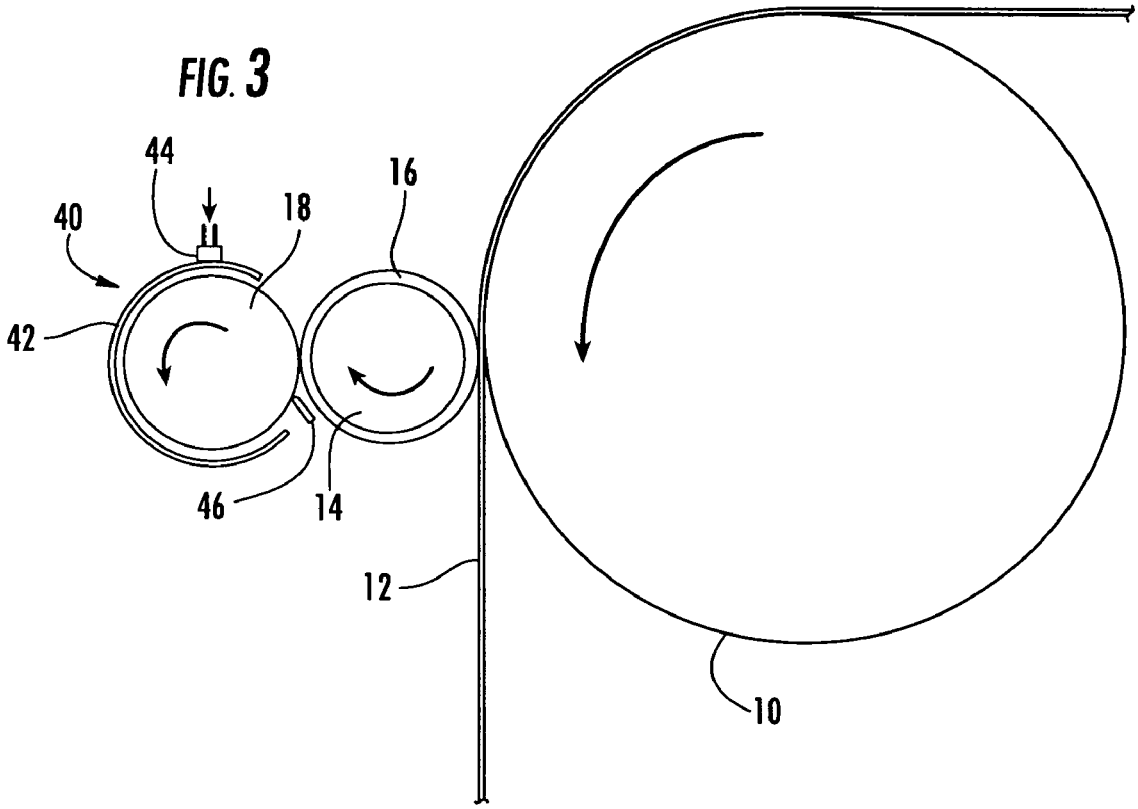
FIG. 3 is schematic elevational view of a flexographic printing apparatus embodied with a liquid transfer arrangement utilizing a transfer roller encasement in accordance with a preferred embodiment of the present invention.
Figure 4:
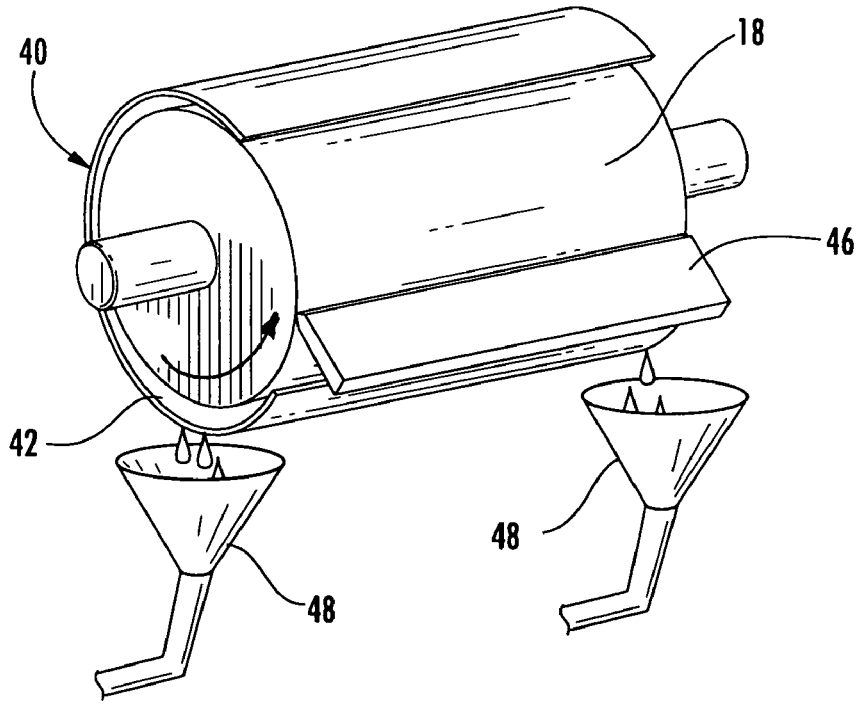
FIG. 4 is a schematic perspective view of the liquid transfer arrangement of FIG. 3 according to the present invention, depicting an optional device for collecting and recycling excess printing liquid.

With reference now to FIG. 3, the present invention provides a uniquely novel form of printing liquid delivery device, generally indicated at 40, which is operative in a flexographic printing apparatus to wet directly the anilox or other transfer roller 18 substantially without generating an excess of printing liquid. Specifically, the delivery device 40 of the present invention provides an encasement 42 arcuately configured in relatively precise conformity to the circumferential periphery of the transfer roller 18 and positioned in immediate adjacency to the transfer roller 18 so as to arcuately surround a predetermined circumferential extent of the peripheral surface of the roller 18 at a substantial uniform radial spacing therefrom. A liquid supply device, which may be of any of various types and is therefore shown only schematically at 44, is mounted to the encasement 42 at its leading upstream end, as viewed in the direction of rotation of the transfer roller 18, for continuously feeding a metered supply of the printing liquid into the radial spacing defined between the encasement 42 and the transfer roller 18. Optionally, a doctor blade or other similar wiping element 46 is secured to the encasement 42 at its trailing downstream end, as viewed in the direction of rotation of the transfer roller 18, for wiping contact with the transfer surface of the transfer roller 18 to remove any excess printing liquid therefrom in advance of the nip area between the transfer roller 18 and the plate cylinder 14.

The encasement 42 extends axially substantially coextensively with the full length of the transfer surface of the transfer roller 18 and, if necessary or desirable, a sealing arrangement (not shown) may be provided between the opposite ends of the encasement 42 and the transfer roller 18 to sealingly enclose the liquid containing space defined within the encasement 42. In addition or alternatively, the delivery device 40 may also optionally be equipped with a liquid collection arrangement 48 disposed at one or both ends of the encasement 42 to recycle any minimal amount of excess printing liquid which may escape the opposite ends of the encasement 42.

In accordance with the present invention, the encasement is dimensioned and configured such that the radial spacing defined between the encasement 42 and the transfer roller 18 is sufficiently narrow for containing a limited quantity of the printing liquid to be carried by the transfer roller to the printing cylinder substantially only as is necessary to maintain the transfer roller surface fully wetted with the printing liquid. For example, in one contemplated embodiment, the constricted radial spacing is selected to substantially approximate the desired thickness of the printing liquid to be carried by the transfer roller 18 to the nip with the plate cylinder 14, whereby the quantity of printing liquid fed into and occupying the radial spacing will be substantially only the film-like thickness desired to be taken up by the transfer roller 18 and transferred to the printing plates 16 of the plate cylinder 14, with minimal or negligible excess printing liquid to be wiped by the doctor blade 46 and/or recovered by the liquid collection arrangement 48. However, as will naturally be recognized and understood by those persons skilled in the art, the actual radial spacing defined by the encasement 44 in any particular given application or embodiment of the present delivery device 40 may be somewhat greater and may depend on various factors, e.g., the chemical and physical characteristics of the particular printing liquid such as its viscosity, and the nature of the printing operation, etc., but it is presently contemplated that the radial spacing in the vast majority of applications and embodiments of present delivery device 40 will provide a radial spacing in the range from about 1 micron to and including about 6350 microns.

Similarly, the arcuate span of the transfer surface of the transfer roller 18 surrounded by the encasement 42 may vary within the scope and substance of the present invention and without departing from the concept thereof, as may be necessary or desirable to ensure uninterrupted film formation of the printing liquid on the transfer roller surface. It is presently contemplated that the arcuate extent of the transfer roller surface surrounded by the encasement 42 should span minimally at least about 30 degrees of the transfer surface, up to an arcuate span surrounding predominately the entire circumferential extent of the transfer roller surface except for the nip area contacting the plate cylinder 14, i.e., up to a maximum span of approximately 355 degrees of the transfer surface. Within this overall range, however, it is contemplated that the majority of applications and embodiments for the delivery device 40 of the present invention will advantageously utilize an encasement 42 surrounding an arcuate span of the transfer roller surface between about 45 degrees and about 230 degrees of the surface.

Those person skilled in the art will therefore readily recognize and understand that the delivery device of the present invention provides several distinctive advantages over the prior art. Most fundamentally, the delivery device 40 of the present invention uniquely contain a quantity of the printing liquid in a thickness substantially approximating only that quantity and thickness desirable to be carried by the transfer surface of the transfer roller 18 to the nip transfer point of contact with the printing plate or plates 16 of the plate cylinder 14. In turn, minimal or negligible excess printing liquid will be produced over the course of use of the present delivery device 40, which in turn is expected to essentially eliminate as much as is practicable waste and disposal of the printing liquid and the cost and environmental considerations attendant thereto. Other advantages and benefits will be apparent to persons skilled in the relevant art.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

What is claimed is:

1. A liquid transfer arrangement for applying a printing liquid to a printing surface, comprising:

a liquid transfer roller having a circumferential transfer surface adapted for carrying a coating of printing liquid, a transfer roller encasement arcuately surrounding a circumferential portion of the transfer surface of the transfer roller and defining therebetween a substantially uniform constricted radial spacing for containing a limited quantity of the printing liquid to be carried by the transfer roller to the printing cylinder, wherein the radial spacing between the encasement and the transfer roller approximates a desired coating thickness of the printing liquid on the transfer roller, and a device associated with the encasement for delivering a supply of printing liquid into the radial spacing defined between the encasement and the transfer roller for takeup of the printing liquid by the circumferential transfer surface of the transfer roller.

2. A liquid transfer arrangement according to claim 1, wherein the circumferential transfer surface of the transfer roller is engraved for collecting a defined film of the printing liquid.

3. A liquid transfer arrangement according to claim 1, wherein the transfer roller is an anilox roller.

4. A liquid transfer arrangement according to claim 1, wherein the encasement extends axially along the transfer roller for substantially the full axial length thereof.

5. A liquid transfer arrangement according to claim 1, wherein the circumferential portion of the transfer surface arcuately surrounded by the encasement spans at least about thirty degrees (30°) of the transfer surface.

6. A liquid transfer arrangement according to claim 5, wherein the circumferential pattern of the transfer surface arcuately surrounded by the encasement spans up to a predominant circumferential extent of the transfer surface.

7. A liquid transfer arrangement according to claim 5, wherein the circumferential pattern of the transfer surface arcuately surrounded by the encasement spans up to about three hundred fifty-five degrees (355°) of the transfer surface.

8. A liquid transfer arrangement according to claim 1, wherein the circumferential portion of the transfer surface arcuately surrounded by the encasement is between about forty-five degrees (45°) and about two hundred thirty degrees (230°) of the transfer surface.

9. A liquid transfer arrangement according to claim 1, wherein the radial spacing between the encasement and the transfer roller is up to and including about six thousand three hundred fifty microns.

10. A liquid transfer arrangement according to claim 1, further comprising a wiping element at a terminal end of the encasement for removing any excess printing liquid from the circumferential transfer surface.

11. A liquid transfer arrangement according to claim 1, further comprising a device for collecting any excess printing liquid.

12. A liquid transfer arrangement for applying a printing liquid for a printing surface, comprising:

a liquid transfer roller having a circumferential transfer surface adapted for carrying a coating of printing liquid, means for arcuately surrounding a circumferential portion of the transfer surface of the transfer roller and defining therebetween a substantially uniform constricted radial spacing for containing a limited quantity of the printing liquid to be carried by the transfer roller to the printing cylinder, wherein the radial spacing between the encasement and the transfer roller approximates a desired coating thickness of the printing liquid on the transfer roller, and means for delivering a supply of printing liquid into the radial spacing defined between the roller surrounding means and the transfer roller for takeup of the printing liquid by the circumferential transfer surface of the transfer roller.

13. A liquid transfer arrangement according to claim 12, wherein the circumferential portion of the transfer surface arcuately surrounded by the roller surrounding means is between about thirty degrees (30°) and about three hundred fifty-five (355°) of the transfer surface.

14. A liquid transfer arrangement according to claim 12, wherein the radial spacing between the roller surrounding means and the transfer roller is from and including about one micron to and including about two hundred fifty microns.

15. In a printing apparatus comprising:

a liquid transfer roller having a circumferential transfer surface adapted for carrying a coating of printing liquid, a printing cylinder in peripheral surface contact with the liquid transfer roller and having a printing plate for receiving the printing liquid from the transfer roller, and an impression cylinder in peripheral surface contact with the printing cylinder for conveying a substrate therebetween to be printed by the printing plate, the improvement comprising:

a transfer roller encasement arcuately surrounding a circumferential portion of the transfer surface of the transfer roller for defining therebetween a substantially uniform constricted radial spacing for containing a limited quantity of the printing liquid to be carried by the transfer roller to the printing cylinder, wherein the radial spacing between the encasement and the transfer roller approximates a desired coating thickness of the printing liquid on the transfer roller, and a device associated with the encasement for delivering a supply of printing liquid into the radial spacing defined between the encasement and the transfer roller for takeup of the printing liquid by the circumferential transfer surface of the transfer roller.

16. The improvement in a printing apparatus according to claim 15, wherein the circumferential portion of the transfer surface arcuately surrounded by the encasement is between about thirty degrees (30°) and about three hundred fifty-five degrees (355°) of the transfer surface.

17. The improvement in a printing apparatus according to claim 15, wherein the radial spacing between the encasement and the transfer roller is from and including about one micron to and including about two hundred fifty microns.

* * * * *